United States Patent [19]

Lindholm

[11] 4,447,082

[45] May 8, 1984

[54] EXCREMENT CLEAN-UP TOOL AND BAGGER

[76] Inventor: Donald W. Lindholm, 15368 Betty Ann La., Oak Forest, Ill. 60452

[21] Appl. No.: 403,486

[22] Filed: Jul. 30, 1982

[51] Int. Cl.[3] ..... A47F 13/06; A01B 1/04

[52] U.S. Cl. ..... 294/1 BA

[58] Field of Search ..... 294/1 BA, 1 BB, 1 B, 294/55, 19 R, 99, 100, 106; 15/257.1, 257.4, 257.6, 257.7, 257.8; 254/209

[56] References Cited

U.S. PATENT DOCUMENTS

| | | | |
|---|---|---|---|
| 943,199 | 12/1909 | Noll | 254/209 |
| 3,804,448 | 4/1974 | Schmieler | 294/1 BA |
| 4,149,745 | 4/1979 | Willis | 294/1 BA |

*Primary Examiner*—James B. Marbert

*Attorney, Agent, or Firm*—Hill, Van Santen, Steadman & Simpson

[57] ABSTRACT

A tool for picking up and bagging excrement and other debris has a tubular scoop on the bottom end of an upright handle post with a removable bag clamped around its rear end at a level above its open front mouth. The tubular scoop body is preferably formed of conventional pipe type plastics material, such as polyvinyl chloride, shaped to present a forwardly projecting scoop lip on the bottom of the open front thereof for sliding under and scraping up the excrement and inclined upwardly and rearwardly from the lip to present the bag receiving rear end at a level above the lip so that the bag will not drag against the surface being scraped. The mouth of the bag is conveniently wrapped around this rear end of the tube and held in position by an easily applied and removed clip or clamp. The handle post is also inclined either forwardly or rearwardly of the tube so that the scoop can be pushed or pulled toward and under the excrement. In one embodiment especially adapted for removing excrement from grass, the front open mouth of the tube is in the shape of a rearwardly inclined oval and the handle is tilted forwardly to pull the scoop under the excrement. In another embodiment, especially adapted for scraping excrement off of hard surfaces, the open front mouth of the tube has a rearwardly extending bottom groove with sharp edges for scraping the excrement and the handle is rearwardly inclined to push the tube.

6 Claims, 7 Drawing Figures

FIG. 1
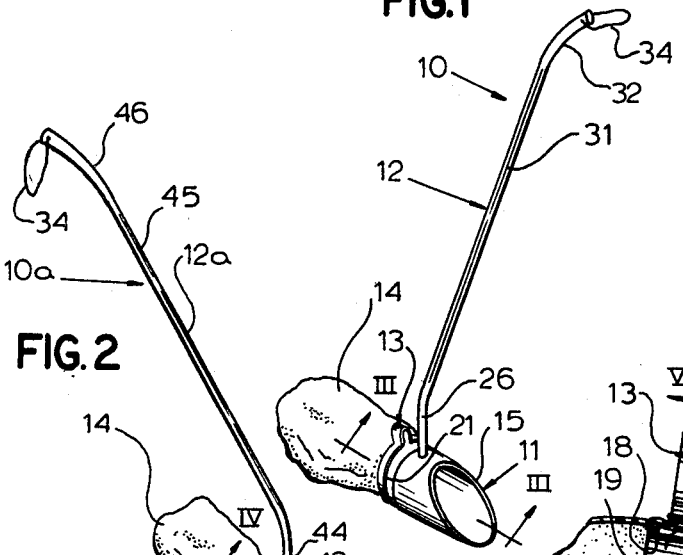
FIG. 2
FIG. 3
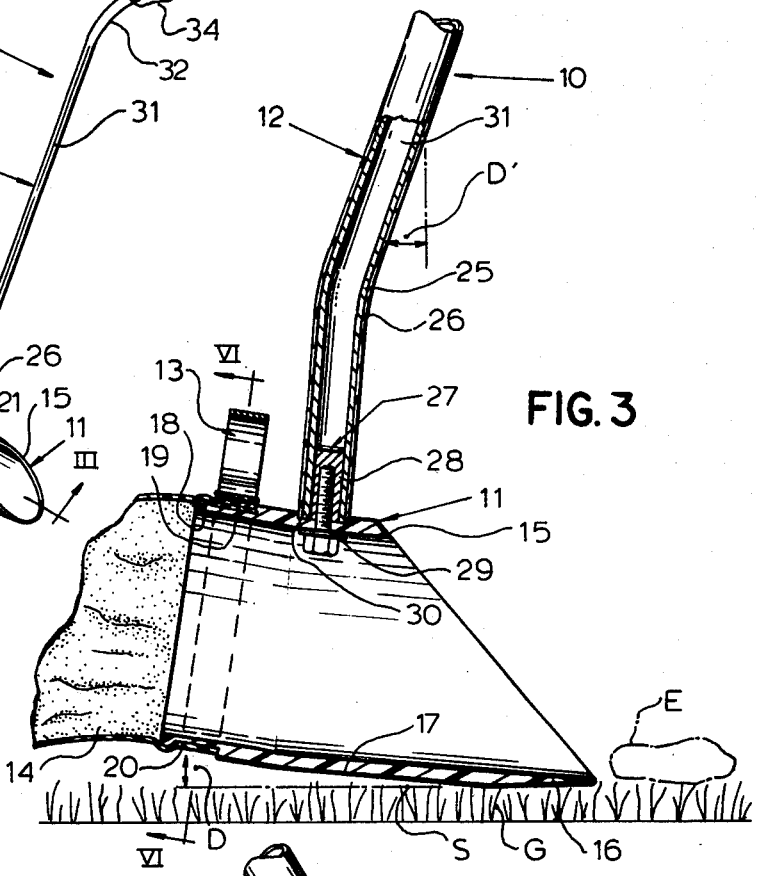
FIG. 5
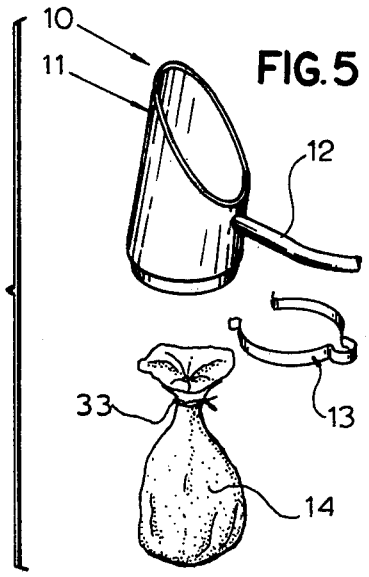
FIG. 4
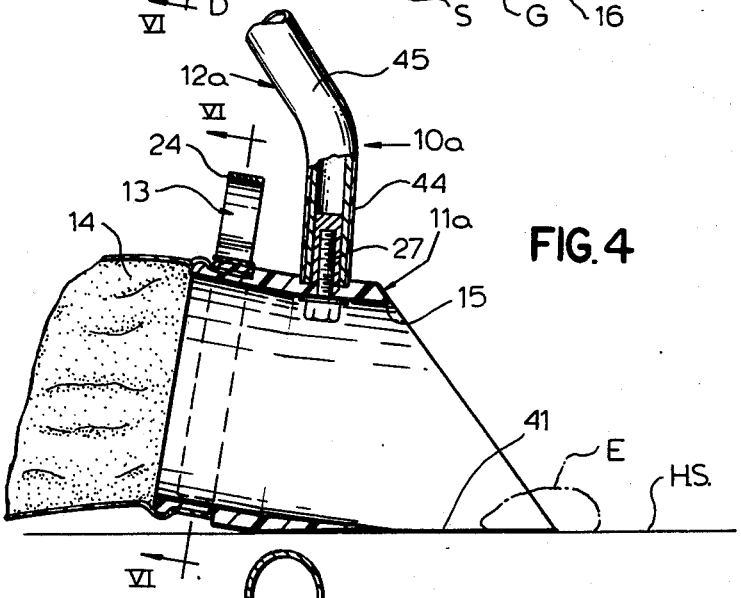
FIG. 7
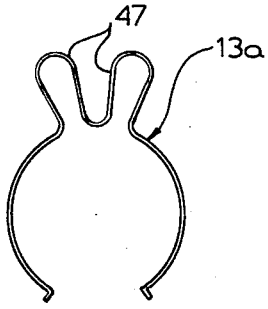
FIG. 6
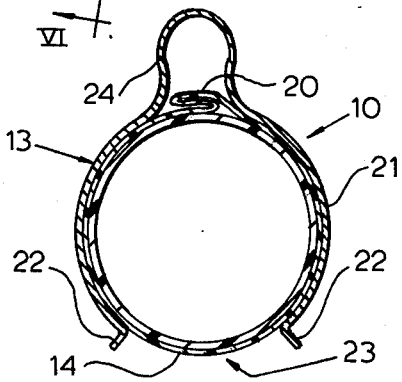

EXCREMENT CLEAN-UP TOOL AND BAGGER

BACKGROUND OF THE INVENTION

1. Field of the Invention

This invention relates to the art of clean-up and pick-up tools operated by pushing or pulling a handle post to scoop up and bag excrement or other debris from hard or soft surfaces, and specifically deals with an inexpensive, easily operated clean-up tool which will pick up and bag excrement and other debris without soiling the user.

2. Description of the Prior Art

Heretofore provided devices for picking up dog excrement and the like from grass and concrete surfaces have required dumping of the picked up material into a separate receptacle, thus frequently soiling the user. These devices generally took the form of conventional dust pans, tongs and spade-like scoops, all of which required manual removal of the picked up material into a separate receptacle. It would, therefore, be an improvement in the art to provide a clean-up tool which not only picks up debris but also discharges it into a disposable receptacle carried by the tool.

SUMMARY OF THE INVENTION

According to this invention, there is provided a clean-up and bagger tool which will pick up excrement and other debris from grass and hard surfaces, discharge the picked up material into a removable bag carried by the tool and has an upright post providing an operating handle at a height which does not require the user to stoop or bend over.

The tools of this invention have a tubular body preferably formed of rigid pipe type plastics materials such as polyvinyl chloride about one-quarter inch thick with an inside diameter of about three inches and a length of about six inches. The front mouth of the tube is inclined rearwardly from the bottom to the top at an angle of about 45° to present an oval rim on the front end of the tube and to expose the bottom wall of the tube in full view of the user. The rear end of the tube is inclined upwardly to present a back rim which is offset by 10° from the axis of the tube. This rim has an external groove with a raised bead over which the mouth of the bag is easily positioned. A spring clamp is easily applied over the mouth of the bag behind the bead to secure the bag to the tube. A conventional plastics material (MYLAR or polyethylene plastic) bag is useful. The retaining clamp conveniently takes the form of a metal or plastics material clip which is easily hand grasped for removal. The scooped up material is easily deposited in the bag by holding the tubular body upright and a conventional bag closure twist type tape or wire can easily be wrapped around the bag below its clamped on mouth for closing the bag prior to removing it from the tubular body.

It is then an object of this invention to provide an excrement clean-up and bagger tool operated from a post presenting a handle at a convenient level and effective to deposit picked up material in a removable bag which is easily sealed prior to or upon removal.

Another object of this invention is to provide an excrement scoop which carries a receptacle bag that is easily filled and removed for disposal.

A further object of this invention is to provide a tool with a tubular scoop on the bottom end of an elongated handle post having an inclined scraper front and a clamped on rear bag receiving the scooped up material.

A specific object of this invention is to provide a dog excrement clean-up and bagger tool with a tubular body having an inclined front scraping end, a raised bag receiving rear end, and an upright handle post inclined to be manipulated by a pulling or pushing action for maintaining the front edge of the body in scooping position with the rear end of the body raised above the ground.

Other and further object of this invention will become apparent to those skilled in this art from the following detailed description of the annexed sheet of drawings which, by way of preferred embodiments illustrate two examples of this invention.

ON THE DRAWINGS

FIG. 1 is a front and side perspective view of a tool according to this invention especially adapted for picking up excrement from a grass surface.

FIG. 2 is a view similar to FIG. 1 but illustrating a modified tool especially adapted for picking up excrement from a hard surface.

FIG. 3 is a cross-sectional view, with parts in elevation, along the line III—III of FIG. 1 and illustrating the operation of the tool.

FIG. 4 is a view similar to FIG. 3 but taken along the line IV—IV of FIG. 2.

FIG. 5 is an exploded perspective view illustrating the removal and closure of a filled bag from the tool.

FIG. 6 is a view taken along the line VI—VI of FIGS. 4 and 5.

FIG. 7 is a side view of a modified clip for the tool.

AS SHOWN ON THE DRAWINGS

The tool 10 of FIGS. 1, 3, 5 and 6 has a plastics material tubular body 11 on the bottom end of an upright handle post 12 with a clamp 13 holding the mouth of a bag 14 around the rear end of the body 11.

The front end of the tubular body 11 is inclined at an angle of about 45° from the bottom to the top of the tube presenting an oval shaped front rim edge 15. The bottom of this rim portion 15 is tapered as shown at 16 in FIG. 3 so that when the tapered bottom 16 is presented parallel to the surface S to be scraped, the tubular bottom portion 17 rearwardly from this edge 16 will be inclined upwardly to be spaced above the surface S. An incline of about 10° as illustrated at D is preferred.

The rear end of the tubular body 11 is circular and has a raised bead 18 therearound rearwardly of a peripheral groove 19. The open end or mouth 20 of the bag 14 is snugly wrapped around the rear end of the tube over the bead 18 and groove 19 and the clip or clamp 13 is positioned around this wrapped end 20 to secure it tightly on the body. The clip 13 is composed of spring metal or a springy resilient plastic band with fragmental cylindrical tong-like side walls 21 shaped to embrace the tubular body 11 and having out-turned ears 22 with an open gap 23 therebetween so that the legs 21 are easily spread and snapped over the tube to fit in the groove 19. The legs 21 are joined by a U-shaped hump 24 providing a spring, the legs of which can be squeezed to expand the rounded legs 21.

The top of the tubular body has the bottom end of the handle post 12 secured thereto just rearwardly of the lip 15. As illustrated in FIG. 3, the handle post can take the form of a hollow metal or plastic tube 25 with a bottom length increment 26 thereof extending normal to the top wall of the tube and secured thereto by an expansion fastener 27 with an expansion plug 28 fitting in the bottom end of the tube and expanded by a bolt 29 passing through a hole in the top wall of the tubular body 11 and having a head and washer bottomed on the inner surface of the top wall of the tubular body 11. The bottom edge of the post portion 26 fits snugly in a recess 30 in the top wall of the tubular body 11.

The leg portion 26 of the handle post 12 extends for a distance of about 8 inches and the post is then inclined forwardly to provide an elongated run 31 at an angle of about 20°, illustrated at D'. The run 31 preferably has a length of about 2 feet. A handle portion 32 then projects forwardly from the upper end of this run 31 as shown in FIG. 1 to be positioned substantially parallel with the tubular body 11. This handle 32 is easily grasped to pull the tool forward over the surface S as shown in FIG. 3. This surface S is defined by grass G and excrement E to be scooped up is deposited on this grass. The tool then is pulled forwardly through the grass and under the excrement E to deposit the excrement into the tube.

Swinging of the handle to a position such as illustrated in FIG. 5 will position the tubular body 11 vertically upright thus depositing excrement into the bag 14. When the bag is filled, it can be sealed with a twist type strip 33 and the clip 13 removed for separation of the closed bag from the tool.

The free end of the handle 32 can have a hanger loop or bail 34 secured thereto for suspending the tool from a hanger when not in use.

From the above description, it will thus be understood that the tool 10 is manipulated by pulling the handle post forwardly over a surface such as grass containing excrement causing the lip 16 to slide under the excrement E depositing the same into the tubular body 11 whereupon tilting of the body to an upright position deposits the excrement into the bag 14. The handle 32 is spaced above the tubular body 11 so that the tool can be operated from a level that does not require the user to stoop or bend over.

In the modified tool **10*a* of FIGS. 1 and 4, parts corresponding with the parts above described for the tool 10 have been marked with the same reference numerals, since they function in the same manner. However, in the modified tool 10*a*, a modified tubular body 11*a* is provided with its front rim 15 having a rearwardly extending V-shaped bottom cut-out or groove 40 providing a front bottom lip with two side legs 41, 41 converging from an open gap 42 at the bottom of the rim 15 to a closed end 43 somewhat inwardly from the top of the rim 15. These side legs 41 provide scraping edges which embrace and cut under excrement E espcially when it is deposited on a hard surface H.S. as shown in FIG. 4**.

The modified handle **12*a* is secured to the tubular body 11*a* in the same manner as the handle 12 is secured to the body 11 in the embodiment 10. However, the modified handle 12*a*, instead of extending forwardly of the body, has an upright bottom end 44 normal to the body 11*a* merged into a rearwardly extending elongated run 45 terminating in a rearwardly tilted handle 46 at the upper end thereof. A 20° angle between the portions 44 and 45 is provided so that the handle portion 46 is positioned rearwardly from the body 11*a*** to be grasped for a pushing action.

The modified tool **10*a* is thus pushed over the hard surface H.S. with the sharp scraping edges 41 cutting excrement that might be fused to or stuck upon the hard surface forcing it into the body 11*a* whereupon tilting of this body to the upright position shown in FIG. 5 will deposit the excrement into the bag 14. The bag, of course, is released from the body 11*a* in the same manner as described in the first embodiment 10**.

The rearwardly sloping rims 15 of both embodiments give the operator an unobstructed view of the scooping action of the bottom lip 16 or the scooping legs 41 on the excrement.

The clip or clamp 13 may be modified as shown at **13*a* in FIG. 7 where the U-shaped knob or top 24 of the clip is shaped to provide a pair of side-by-side ears 46 which can be squeezed toward each other to spread the legs 21** for releasing the clamp.

From the above descriptions, it will thus be clear that this invention provides a tool which is pushed or pulled from a convenient height to clean up excrement from grass or hard surfaces and deposit the same into a removable bag which is easily sealed and removed from the tube when full and is easily applied to the tool when empty. It will also be understood that the invention is not limited to the two preferred illustrated embodiments, since many variations and modifications are available without departing from the scope of this application and the appended claims.

I claim as my invention:

1. An excrement clean-up tool and bagger which comprises a tubular body having a rearwardly inclined open front end providing a bottom scraping lip visible from the top of the body, said scraping lip having a central open front longitudinal groove providing scraping edges along the sides thereof, said body having an upwardly inclined open rear end adapted to receive the mouth of a bag therearound, a releasable clamp adapted to surround the mouth of a bag mounted around the back of the body for securing the bag to the body, an upright handle post extending from the top of the body, a handle on the top end of the post positioned to be grasped by a user for propelling the scraping lip over a surface and under excrement deposited on the surface and to discharge the picked-up excrement into a bag mounted on the back end of the body, and said upwardly inclined rear end holding the bag mouth and clamp above and out of contact with the surface as the scraping lip is propelled on the surface.

2. The tool and bagger of claim 1, wherein the scraping edges converge from the front to the back of the groove.

3. The tool and bagger of claim 1 wherein the upright handle post is inclined rearwardly of the body to push the tool over debris to be picked up.

4. An excrement clean-up tool and bagger which comprises a tubular body having a rearwardly inclined open front end providing a bottom scraping lip with a front edge visible from the top of the body, said lip having a bottom surface tapered to said front edge to engage a surface to be scraped, said tubular body having an open rear end portion with an axis upwardly inclined from the axis of the tube adapted to receive the mouth of a bag therearound, a releasable clamp adapted to surround the mouth of a bag mounted around said rear end portion of the body for securing the bag to the body, an upright handle post extending from the top of the body, a handle on the top half end of the post positioned to be grasped by a user for propelling the scraping lip over a surface and under excrement deposited on the surface and to discharge the picked up excrement into a bag mounted on the back of the body and said upwardly inclined rear end portion holding the bag mouth and clamp above and out of contact with the surface as the scraping lip is propelled over the surface.

5. A clean-up and bagger tool which comprises a tubular body having an open front end for scooping up debris and an open back end portion having an axis upwardly inclined from the axis of the body, said open front end of the tubular body being rearwardly inclined with a bottom scraping lip visible from the top of the body, said lip having a bottom face tapered to the front edge thereof, a bag projecting from the back of the body having a mouth surrounding the open back end portion thereof, a clamp for securing the mouth of the bag on the body, an upstanding handle rigidly affixed to said body to propel the open front end of the body to propel the tapered lip face over a surface and under excrement to be scooped up from the surface for deposit in the bag, and said tapered lip cooperating with said inclined axis rear end portion of the body holding the bag and clamp out of scraping contact with the surface.

6. The tool of claim 5, wherein the handle post is inclined forwardly of the body to pull the tool over debris to be picked up.

* * * * *